United States Patent [19]

Saida et al.

[11] Patent Number: 4,686,068

[45] Date of Patent: Aug. 11, 1987

[54] METHOD OF BATCHWISE TREATING RADIOACTIVE ORGANIC WASTES

[75] Inventors: Toyoyasu Saida, Fujisawa; Takahisa Sunagawa, Narita; Tsuneo Yamakawa, Mobara; Norima Ohta; Keishi Obara, both of Chiba, all of Japan

[73] Assignee: Toyo Engineering Corporation, Funabashi, Japan

[21] Appl. No.: 753,196

[22] Filed: Jul. 9, 1985

[30] Foreign Application Priority Data

Jul. 10, 1984 [JP] Japan ..... 59-142833

[51] Int. Cl.[4] ..... G21F 9/14; F23G 5/12

[52] U.S. Cl. ..... 252/632; 110/237; 110/342; 110/346; 159/DIG. 12; 252/626

[58] Field of Search ..... 252/626, 631, 632; 110/237, 342, 238, 343, 346, 347; 159/47.3, DIG. 12; 422/159, 903

[56] References Cited

U.S. PATENT DOCUMENTS

| | | | |
|---|---|---|---|
| 3,666,673 | 5/1972 | Knoll | 252/632 |
| 4,276,834 | 7/1981 | Bregulla et al. | 252/626 |
| 4,377,508 | 3/1983 | Rothberg | 252/631 |
| 4,499,833 | 2/1985 | Grantham | 252/632 |
| 4,555,361 | 11/1985 | Buckley et al. | 252/632 |

FOREIGN PATENT DOCUMENTS

| | | | |
|---|---|---|---|
| 0094199 | 7/1980 | Japan | 252/632 |
| 0001446 | 1/1982 | Japan | 252/626 |
| 0012399 | 1/1984 | Japan | 252/632 |
| 0061697 | 4/1985 | Japan | 252/632 |
| 2080605 | 2/1982 | United Kingdom | 252/626 |

*Primary Examiner*—John F. Terapane
*Assistant Examiner*—Howard J. Locker
*Attorney, Agent, or Firm*—Flynn, Thiel, Boutell & Tanis

[57] ABSTRACT

A method of batchwise oxidatively reducing radioactive wastes mainly composed of various combustible or poorly combustible organic compounds or the mixtures thereof and containing a small amount of inorganic substances. The oxidative decomposition is carried out in an aqueous solution containing a fusion-preventive agent and a catalyst. The process allows radioactive waste to be oxidatively decomposed effectively and safely while requiring low amounts of energy thereby permitting the volume of the final wastes to be discharged and stored after the oxidative decomposition to be minimized.

8 Claims, No Drawings

METHOD OF BATCHWISE TREATING RADIOACTIVE ORGANIC WASTES

BACKGROUND OF THE INVENTION

1. Field of the Invention

This invention concerns a method of treating radioactive wastes mainly composed of various combustible and/or poorly combustible organic materials, or mixtures thereof with inorganic materials.

2. Description of the Prior Art

Various kinds of radioactive organic waste are generated in nuclear power plants and facilities handling radioactive substances. At present, some of these wastes are partially treated, but most are left untreated. That is, the waste is charged and stored in an untreated state in drums or other containers. Filtration aids, spent ion exchange resins and the like, are stored, as they are, along with liquid waste in storage tanks.

The amount of radioactive wastes generated will increase over time, and the places or facilities for storing accumulated radioactive wastes will inevitably be filled up. Furthermore, when solid radioactive wastes are stored, as they are, mixed with liquid waste in storage tanks, safety problems may arise. Accordingly, there is an urgent demand for developing end establishing a practical treating method for solving these problems.

Various methods of treating radioactive wastes, such as, compaction, incineration and acid digestion, are now under development or have been put to practical use. However, these waste treatment methods have serious drawbacks which limit their utility. The compaction method does not exhibit an effective volume-reduction ratio of the treated radioactive wastes, and therefore does not satisfactorily minimize the required waste storage space. Furthermore, the substances which can be processed by the compaction method are limited. Referring to the incineration method, there is an additional requirement for facilities to seperate and remove sulfur oxides, nitrogen oxides, chlorine, hydrogen chloride and fine ash that are contained in a large volume in the gaseous wastes generated during incineration. Also, secondary radioactive wastes are generated from the treatment or the geseous wastes. Therefore, in the incineration method, the volume-reduction effect of the treatment is offset by the above named problems and another problem is caused by corrosion or the incineration facilities.

There has been well known a wet oxidation process which is employed in the treatment of liquid wastes containing ordinary organic substances, in which the liquid wastes are continuously introduced into an oxidizing reactor at a high temperature end high pressure end are subjected to air oxidation. However, the oxidizing reaction tends to be terminated at the formation of organic acids in this method. As a means for avoiding this defect and improving the degree of oxidation, it has also been known that the addition of a catalyst, such as copper ions, is effective for oxidizing the organic substances more completely. It may be possible to apply such a conventional continuous wet oxidizing process to radioactive organic wastes. However, there have been various drawbacks such as (1) the degree or oxidation or the organic meterials is low, (2) a great amount of waste water containing radioactive substances end heavy metals used as the catalyst are discharged thereby creating various problems in the treatment or the discharged waste water and (3) if thermoplastic high molecular polymeric substances are contained in the radioactive wastes, they will be melted in the reactor and fused together (hereinefter referred to as fusion) with other organic wastes, thereby forming large lumps which hinder the progress of the oxidizing treatment. Because of these drawbacks, application of the wet oxidizing process to treat radioactive wastes has not yet been put to practical use.

It is usually difficult to treat a waste mixture, at the location at which it is generated, to separate it into its respective kinds of components and discharge them separately. Similarly, it is more difficult, if not impossible, to subsequently treat a waste mixture to separate those different kinds or components. If the wastes contain naturally radioactive substances, this difficulty is increased more remerkably.

SUMMARY OF THE INVENTION

Accordingly, it is a first object of this invention to provide a method of treating a mixture of organic radioactive wastes, which mixture may or may not also contain inorganic wastes.

The second object or this invention is to provide a method of treating radioactive wastes containing thermoplastic, high molecular weight, polymeric materials without seperating or removing such polymeric materials in advance, even though such polymeric materials have heretofore caused problems in carrying out the treatment or radioactive wastes by the wet oxidizing process.

The third object or this invention is to provide a method of treating radioactive wastes by wet oxidization in which the only required pre-treatment is to cut the waste materials into a predetermined size and configuration so that they can be fed into an oxidizing reactor.

The fourth object or this invention is to increase the volume-reduction ratio achieved by the treatment of the radioactive organic wastes and, as a result, minimize the volume or the final waste to be stored.

The fifth object of this invention is to provide a method of oxidizing radioactive wastes safely and effectively and which requires a low amount of energy.

These and other objects of the invention will become more apparent from a reading of the detailed description and examples which follow.

DETAILED DESCRIPTION OF THE INVENTION

Specifically, this invention provides a method of batchwise treating radioactive organic waste, which comprises: introducing radioactive organic waste into a reactor containing an aqueous solution of a fusion-preventing agent composed of one or more powdery solid substances selected from the group consisting of silicon dioxide and carbonates, hydroxides and oxides of calcium, barium, iron and zinc, in an amount within the range from 1.0 to 7.0%, based on the weight of the radioactive organic waste to be treated; tightly closing and heating said reactor to an internal temperature from 180° to 250° C.; supplying an oxygen-containing gas under pressure into the reactor so as to provide an oxygen partial pressure inside the reactor within the range of from 3 to 25 kg/cm$^2$; oxidatively decomposing the radioactive organic waste in the reactor while discharging gaseous effluent composed mainly or carbon dioxide, steam and noncondensable gases, while maintaining the pH value of the aqueous solution between 0.01 and 8; and thereafter supplying another batch of radioactive organic waste end fusion-preventing agent into the inorganic substance, catalyst and aqueous solution that remains in the reactor, and repeating the oxidative decomposition under the same conditions as described above.

The wet oxidizing process in this invention is carried out batchwise. The readily suspendable, powdery, fusion-preventing agent is added in each cycle of the oxidizing reaction in order to prevent fusion of the radioactive waste which fusion would otherwise hinder the progress of the oxidative decomposition. As shown in the examples to be described later, it is extremely important to employ the powdery substence in an aqueous solution in the reactor to prevent the waste from fusing. By carrying out the wet oxidization batchwise, most of the radioactive substances contained in the starting waste remain in and are concentrated in the reactor and the volume of the final waste containing the radioactive substances is minimized to the utmost extent.

The wet oxidizing process, according to this invention, is carried out in the presence of a catalyst, oxygen and water. The optimum reaction temperature is from 180°-250° C., preferably, 200°-230° C. The total reaction pressure is between 13-120 kg/cm$^2$, prererably, 15-100 kg/cm$^2$. If the temperature is lower than 180° C., the reaction rate of the exidizing decomposition is low even when a catalyst is used and the oxygen partial pressure is maintained high. On the other hand, if the temperature is higher than 250° C., an extremely thick-walled reactor will be required in view of the corrosion which will occur. Thus, both excessively low and excessively high temperatures are not practical. The total pressure as described above is the sum of (1) the autogenous steam pressure inside the reactor which is dependent on the temperature employed, (2) the pressure of the oxygen-containing gas supplied for effecting oxidation and (3) the partial pressure of carbon dioxide and other gases formed as the result of the oxidizing reaction.

As the substances used for the fusion-preventing agent, substances which can easily be suspended in water and which have a relatively low solubility in water, such as carbonates, hydroxides and oxides of calcium, iron, zinc and barium, and silicon dioxide, are extremely useful. The fusion-preventing agent is added as a powder or in the form of an aqueous slurry into the reactor. The fusion-preventing agent can be added as a single compound or as a mixture of two or more compounds selected from the above-named group of compounds. The amount of the fusion-preventing agent added is from 1.0 to 7.0% by weight, preferably, from 2 to 4% by weight, based on the weight of the radioactive waste introduced in one batch portion to the reactor in the batchwise oxidizing reaction. If the amount of fusion-preventing agent is less than the above-mentioned lower limit, a sufficient fusion-prevention effect cannot be obtained. On the other hand, if it is added in an amount in excess of the above-mentioned upper limit, the amount of the final wastes discharged as the residue of the oxidizing treatment is increased whereby to lessen the volume-reduction ratio obtained by the treatment.

In the aqueous solution within the reactor in the method according to this invention, a catalyst metal capable of dissolving in the aqueous solution and/or a catalyst metal deposited on a solid support or carrier can be used as the catalyst. The metals that are effective as a catalyst and are capable of dissolving in the solution are one or more members selected from the group consisting of copper, cobalt, iron, palladium, cerium, nickel, chromium, manganese, lead, platinum and ruthenium. Among them, the use of copper, iron, cobalt, cerium, nickel, chromium and manganese either alone or as a combination of two or more numbers of this group, is effective and inexpensive. These metals are usually introduced into the reactor in the form of a water-soluble compound of the metal, such as a nitrate, sulfate or chloride, in the form of a powder or a solution. The amount of the metal catalyst present in the aqueous solution, expressed as the total amount thereof calculated as the metal, is from 10 to 50,000 ppm by weight, preferably from 50 to 1,000 ppm by weight, based on the weight of the aqueous solution.

It is necessary to add from 10 to 1,000 ppm by weight of the metal catalyst to the solution in order to carry out the first batchwise oxidation cycle. Since the aqueous solution in the reactor is not discharged, the metal catalyst remains present for the second and subsequent batchwise cycles of the oxidizing reaction. Moreover, the radioactive wastes often contain small amounts of the metal elements as described above and other inorganic substances which are effective as a catalyst. As the oxidizing decomposition of the radioactive organic waste proceeds, the metal elements effective as a catalyst contained in the waste are leached out into the aqueous solution and, accordingly, the amount of the catalyst metals in the aqueous solution increases as the batchwise oxidizing treatment is repeated. When the amount of the catalyst metals in the aqueous solution reaches a certain level, these metals deposit in the form of various solid compounds, depending on the type and the amount of anions which are present in the aqueous solution. The deposited solid matter also contains other inorganic substances which are contained in the radioactive waste and are deposited similarly. When a large amount of deposited solid matter accumulates within the reactor, the fluidizing property of the aqueous solution is impaired so as to hinder the oxidizing reaction from proceeding at an acceptable reaction rate. When this occurs, it becomes necessary to remove the deposited solid matter. The deposited solid matter is usually removed by drawing the solid matter to the bottom of the reactor and then removing them as a slurry from the reactor, after the previous oxidizing reaction cycle has been completed and before the radioactive waste and the fusion-preventive agent are added for the next cycle.

The upper limit for the amount of the catalytic metal element that is present in the aqueous solution within the reactor gives a general criterion for determining the amount of the catalyst that is present at the time when the deposited solid matters are to be drained off. For the reason described above, in the wet oxidizing process, according to this invention, it is not necessary to add a soluble catalyst for each batchwise treatment other than in the case of the first cycle of the batchwise oxidizing reaction and in the case where most of the aqueous solution within the reactor has been drained off in order to remove the accumulated deposited solid matter. Presence of metals, other than the catalyst metals, during the oxidizing treatment gives no undesired effects on the oxidizing decomposition reaction.

Instead of a catalyst which is soluble in an aqueous solution, other catalysts can be used comprising one or more metals selected from the group consisting of copper, cobalt, palladium, platinum and ruthenium, or water-insoluble compounds of these metals which metals or water-insoluble compounds thereof are supported on granular carriers, such as alumina, silica-alumina or zeolites. The amount of the catalyst metal or the water-insoluble compound of the catalyst metal is from 1 to 10% by weight based on the sum of the weights of the catalyst metal or water-insoluble compound thereof plus the carrier. The supported catalyst can be present at a weight ratio of from 10 to 200% by weight and, preferably, from 20 to 150% by weight, based on the weight of the radioactive wastes treated in a single batch treatment. The necessary amount of the catalyst metal, when a supported catalyst is used, is from 1,000 ppm to 20% by weight, based on the weight of the radioactive waste treated. If the amount of catalyst is less than 1000 ppm, the reaction rate of the oxidizing decomposition may be extremely slow, depending on the type of the waste being processed, which impairs the practicality of the process as a waste treating method. On the other hand, if the supported catalyst is present in an amount exceeding 20% by weight, the amount of the solid matter in the reactor becomes excessively large and tends to undesirably hinder the oxidizing treatment. By selecting the proper size and configuration for the catalyst carrier, the supported catalyst can easily be separated and recovered from the aqueous solution and the deposited solid matters in the reactor, and can be used repeatedly for many times until its catalytic activity is lost. Accordingly, noble metals can also be used as the catalyst metal for the supported catalyst. Also, when a supported catalyst is used, if various elements, capable of acting as the soluble metal catalyst, are contained in the wastes, these soluble catalyst metals are leached out in the aqueous solution in the same manner as described above and also act as a co-catalyst. The use of the supported catalyst is capable of maintaining the oxidizing decomposition at a high efficiency if the content of the soluble metal catalyst in the wastes is low.

Although substantially pure oxygen is best employed as the oxygen source for the oxidizing decomposition, oxygen-enriched air or untreated air can also be used. A suitable oxygen partial pressure in the reactor during the oxidizing treatment is from 3 to 25 $kg/cm^2$ preferably, from 5 to 20 $kg/cm^2$. If the oxygen partial pressure is less than the lower limit of the range, the oxidizing treatment is not practical because the reaction rate is low. On the other hand, an oxygen partial pressure in excess of the upper limit is not usually necessary and renders the apparatus expensive to operate.

The pH value of the aqueous solution in the reactor during the oxidizing treatment is less than 8 and, preferably, is from 3 to 6. A pH in excess of 8 is not practical because the reaction rate is low. Radioactive waste often contains elements, for example chlorine and sulfur, that produce acidic substances such as hydrogen chloride and sulfuric acid, as a result of the oxidizing treatment. Accordingly, the pH value of the aqueous solution often can be maintained at less than 8 without adding an acidic substance from outside the system to the reactor, because such an acidic substance is formed in the aqueous solution with the progress of the oxidation. If the pH of the aqueous solution in the reactor goes below 7, the fusion-preventing agent starts to dissolve partially. Provided that the fusion-preventing agent does not dissolve rapidly, such partial dissolving does not hinder the fusion-preventing function of the fusion-preventing agent. That is, after the oxidizing reaction has proceeded to some extent, the surface states of the radioactive wastes are changed and the wastes exhibit a reduced tendency to fuse even if they are melted. The pH of the aqueous solution in the reactor during the oxidizing is suitably maintained at more than 0.01, preferably, more than 3, because the materials of which the reactor is made are liable to be corroded at a pH of less than 0.01. Therefore, when the radioactive wastes contain a great amount of chlorine or sulfur, it may be desirable to add a basic substance, for example, an aqueous solution of sodium hydroxide, to the reactor in an amount dependent upon the amount of the elements that are capable of causing the formation of the acidic substances, so that the pH value of the aqueous solution in the reactor is not reduced to less than 0.01 during the oxidation.

The materials from which the reactor is made can be selected from various kinds of highly corrosion-resistant materials such as stainless steel, titanium, zirconium, tantalum, glass or ceramics. An autoclave-type reactor equipped with a stirrer and/or sparger for feeding gas under pressure or a bubble tower type reactor equipped with a distributor for feeding in gas under pressure is suitable.

During every cycle of the oxidizing decomposition, it is necessary to draw off the carbon dioxide that is evolved as the result of the oxidizing decomposition. when the carbon dioxide is drawn off, other gases and the oxygen-containing gas are partially drawn off simultaneously. The gaseous products contain some, although very little, radioactive substances. Accordingly, the gaseous effluents discharged from the reactor are cooled once to condense the vapors and separate the condensates and, thereafter, are further filtered through a high efficiency particulate air (HEPA) filter to collect the radioactive substances. The thus-cleaned gaseous effluents are then sent out of the system, whereby the external escape of the radioactive substances can completely be prevented. The condensates are preferably returned to the reactor.

Further, a defoaming agent can optionally be used for suppressing foaming in the reactor in order to minimize the content of the radioactive substances contained in the gaseous effluents and in order to promote catalytic activity. As the defoamer, any of the well-known defoaming surface active agents can be used, particularly, silicon-type defoamers can provide a satisfactory result. The amount of defoaming agent to use ranges from about 10 to about 2,000 ppm by weight, based on the weight of the aqueous solution.

From 1 to 3 hours is sufficient time for completing one batch of the oxidizing decomposition reaction, although this time period will naturally vary depending on the radioactive wastes to be treated. The longest time required for treating a substance, as determined by experimental results. was that activated carbon required three hours. Substances other than activated carbon can completely be treated in two hours or less.

The reaction conditions for each cycle of the oxidizing treatment by the method of this invention have been described above. It is not necessary to separate and recover the catalyst, inorganic substances and incompletely oxidized organic substances present in the state of an aqueous suspension or solution thereof, upon the completion of each cycle. The organic wastes and fusion preventing agent for treatment in the next cycle are charged at the beginning of each batchwise cycle of operation and the subsequent oxidizing treatment is performed. In this way, the oxidizing decomposition treatment is repeated for many cycles before it becomes necessary to remove solids and liquids remaining in the autoclave. When the amount of the deposited solid matter in the aqueous solution in the autoclave exceeds 30–35% by weight, it is sufficient to bring about difficulty in charging the radioactive wastes in the reactor or hinder the advance of the oxidizing reaction at a sufficient rate. Then, the deposited solid matters in the aqueous solution are precipitated in the reactor and drained off as a slurry after the residual organic substances in the reactor have completely been oxidized. The slurry is subjected to solid-liquid separation by any conventional procedure to recover the supported catalyst. The liquid component is returned for re-use in the reactor. The cake of deposited solid radioactive waste matter is charged into a container as the final waste product of the oxidizing treatment, with or without drying. The treatment is thus completed. The aqueous solution containing the dissolved catalyst metal remains in the reactor upon draining off the deposited solid matter and can, of course, be used for the subsequent oxidizing decomposition reaction. The aqueous solution containing the soluble catalyst metal can be used for more than 20 cycles. Since the catalyst and the aqueous solution can thus be used repeatedly, the final volume reduction ratio of the radioactive wastes is extremely high. In the overall method according to this invention, it is necessary to charge the radioactive waste, the catalyst and the fusion preventing agent into the reactor at the first cycle of the batchwise oxidizing treatment upon starting the operation of the reactor, but no catalyst is charged during the second or subsequent batchwise cycles of treatment. The method according to this invention is carried out continuously in the sense that the same catalyst is used throughout and the batchwise oxidizing treatment is carried out repeatedly. It is necessary to charge only the radioactive waste and the fusion preventing agent for each batchwise oxidizing treatment and to drain off the deposited solid matters in the reactor every 20–30 cycles of the batchwise oxidizing treatment.

The radioactive organic wastes to be oxidatively docomposed by the method according to this invention, include diverse substances, for example, thermoplastic polymeric substances such as polyethylene, polypropylene, polyvinyl chloride, polyvinylidene chloride, natural rubber, synthetic rubber, polychloroprene, polyamide, polyester, polyacrylic ester and polymethyl methacrylate, as well as mixtures of these polymeric substances with various kinds of organic substances such as activated carbon, various hydrocarbons, various alcohols, various organic acids, cellulose, ion exchange resins, thermosetting polyesters, vulcanized but not fused natural rubber, synthetic rubber and polychloroprene rubber, and a certain amount of inorganic substances. Referring to specific embodiments of the radioactive wastes, they include miscellaneous mixtures of rags, wood products, mineral oil products, filtration aids, cloths, safety devices, instruments, table wares, working tools or the like. Radioactive elements are present mainly as inorganic substances in these wastes. These radioactive wastes are charged into the reactor in the state, as they are, pre-treatment is not required and, accordingly, no secondary wastes are generated due to the pre-treatment. It is of course desired that the readioactive wastes be as finely divided as possible for charging into the reactor, provided that the size reduction treatment does not cause generation of secondary wastes. Accordingly, the reactor may have to be equipped with a large size radioactive waste supply port. Those large sized radioactive waste products that cannot pass the waste supply port in the form they are in, are dismantled or broken up in such a way as to prevent the generation of secondary waste and then are charged into the reactor through the waste supply port.

The advantages and merits of the invention are summarized as follows. The first advantage is that radioactive waste containing thermoplastic polymeric msterials can be oxidatively decomposed by the wet oxidizing process without necessitating separation and removal of thermoplastic polymeric materials, because of the use of the fusion preventing agent. The second advantage is that the volume-reduction ratio for the organic waste containing the radioactive elements is increased and the inorganic substances containing these elements are concentrated in the reactor to successfully reduce the volume of the final waste to be stored due to the use of the batchwise wet oxidizing process.

The method according to this invention will now be described specifically referring to illustrative examples.

EXAMPLE 1

In this example, the effectiveness of the fusion preventing agent was tested. An autoclave having an inner volume of 500 ml was used and soft vinyl chloride sheets and polyethylene bottles cut into pieces of an average size of 30 mm square were used as waste. The decomposing treatment was carried out as described below while adding powder of calcium carbonate, calcium hydroxide, iron oxide, zinc oxide, barium carbonate and silicon dioxide as the fusion preventing agent, each in a different addition amount.

The autoclave was charged with 10 g of waste, 250 ml of water, 0.2 g of copper sulfate pentahydrate (500 ppm by weight, calculated as copper based on water) as the water-soluble catalyst, from 0.5 to 7.0% by weight of each of the fusion preventing agents based on the weight of the waste and from 2.0 to 4.5 g of solid sodium hydroxide as a neutralizing agent. After tightly closing the autoclave, the autoclave was heated while the contents thereof were stirred by a stirrer rotated at 600 rpm. When the temperature reached 220° C., a gas comprising 99% oxygen by volume was introduced to produce a partial pressure of oxygen inside the autoclave of 17 kg/cm$^2$ in addition to the autogenous steam pressure. The decomposition reaction was carried out for one hour. During the reaction, gases were occasionally drawn off from the top of the autoclave and oxygen was added to the interior of the autoclave so that the oxygem partial pressure was maintained at 17 kg/cm$^2$ whereby to keep the total pressure within the autoclave at 40–42 kg/cm$^2$. The drawn-off gases were indirectly cooled by water, the condensates were returned by means of a pump to the inside of the autoclave and the amounts of the oxygen and carbon dioxide in the uncondensed gases were analyzed. When the reaction was over, the stirring was interrupted and, after cooling the autoclave to room temperature, the internal gases were discharged. Measurement was carried out, after opening the cover of the autoclave for the pH value of the aqueous solution remaining in the autoclave, the total organic content (hereinafter simply referred to as TOC) in the liquid and TOC for the residual solid organic component by using a TOC analyzer. The conversion, for the wastes was calculated by the following equation:

$$\text{Conversion} = \frac{\left(\begin{array}{c}\text{TOC}\\ \text{for}\\ \text{wastes}\end{array}\right) - \left(\begin{array}{c}\text{TOC for resi-}\\ \text{dual aqueous}\\ \text{solution}\end{array}\right) - \left(\begin{array}{c}\text{TOC for}\\ \text{residual}\\ \text{solid wastes}\end{array}\right)}{\text{TOC for wastes}} \times 100$$

TOCs for the wastes and the residual organic solid component in the above equation were calculated from the result of the elementary analysis. The test results are shown in Table 1.

TABLE 1

| Kind of wastes | Fusion preventing agent Kind | Addition amount % by wt. | Conversion % | NaOH amount gr | pH value of aqueous solution |
|---|---|---|---|---|---|
| Sheet | $CaCo_3$ | 0.5 | 60.5 | 2.0 | 6.8 |
| Sheet | $CaCo_3$ | 1.0 | 91.3 | 5.0 | 5.7 |
| Sheet | $CaCo_3$ | 5.0 | 92.5 | 4.5 | 4.1 |
| Sheet | $CaCo_3$ | 7.0 | 90.2 | 4.0 | 3.9 |
| Sheet | $Ca(OH)_2$ | 5.0 | 89.8 | 4.5 | 3.9 |
| Sheet | $Fe_2O_3$ | 5.0 | 90.8 | 5.0 | 4.2 |
| Sheet | ZnO | 5.0 | 88.6 | 4.5 | 4.3 |
| Sheet | $BaCO_3$ | 5.0 | 91.3 | 4.5 | 3.9 |
| Sheet | $SiO_2$ | 5.0 | 92.0 | 5.0 | 4.5 |
| Bottle | $CaCO_3$ | 5.0 | 98.2 | 2.0 | 5.5 |

In Table 1, when 0.5% by weight of calcium carbonate were added, the waste became fused in a large lump and remained incompletely oxidatively decomposed, which reduced the conversion. From the results, it will be apparent that addition of the fusion preventing agent in an amount of from 1 to 7% by weight, based on the weight of the radioactive waste, is effective for preventing the fusion of the waste.

EXAMPLE 2

In this example, the same autoclave as in Example 1 was used and the effect of the oxygen pressure was tested. In this example, each sample weighed 2.0 g. The samples were composed of either dried granular ion exchange resins or the same cut pieces of the soft vinyl chloride sheets, as described in Example 1. The test was carried out under the same conditions as those in Example 1 except that 0.1 g of calcium carbonate was used as the fusion preventing agent, 0.9 g of sodium hydroxide was added as the neutralizing agent and the oxygen partial pressure was in the range of from 2 to 25 kg/cm$^2$. The test results are shown in Table 2.

TABLE 2

| Kind of waste | Oxygen partial pressure kg/cm$^2$ | Total reaction pressure kg/cm$^2$ G | Conversion % |
|---|---|---|---|
| Sheet | 2.0 | 25.2 | 47.0 |
| Sheet | 3.0 | 26.5 | 73.5 |
| Sheet | 17.0 | 41.0 | 86.5 |
| Sheet | 25.0 | 50.0 | 93.2 |
| Resin | 2.0 | 25.2 | 49.0 |
| Resin | 3.0 | 26.5 | 73.5 |
| Resin | 5.0 | 28.5 | 81.3 |
| Resin | 17.0 | 41.0 | 93.5 |

TABLE 2-continued

| Kind of waste | Oxygen partial pressure kg/cm$^2$ | Total reaction pressure kg/cm$^2$ G | Conversion % |
|---|---|---|---|
| Resin | 25.0 | 50.0 | 97.5 |

From the above results, it can be seen that an oxygen partial pressure of higher than 3 kg/cm$^2$ is required.

EXAMPLE 3

In this example, the same autoclave as described in Example 1 was used and the effect of the reaction temperature was tested. In this Example, 2 g samples of the same materials as those described in Example 2 were used and the oxygen partial pressure was maintained constant at 17 kg/cm$^2$. The test was carried out under the same test conditions as those described in Example 1 except that the reaction temperature was varied within the range of from 160° to 250° C. The test results are shown in Table 3.

TABLE 3

| Kind of waste | Total reaction pressure kg/cm$^2$ G | Reaction temperature °C. | Conversion % |
|---|---|---|---|
| Sheet | 23.5 | 160 | 37.0 |
| Sheet | 27.5 | 180 | 77.3 |
| Sheet | 33.0 | 200 | 81.6 |
| Sheet | 41.0 | 220 | 86.5 |
| Sheet | 57.0 | 250 | 92.7 |
| Resin | 23.5 | 160 | 50.3 |
| Resin | 27.5 | 180 | 80.0 |
| Resin | 33.0 | 200 | 86.0 |
| Resin | 41.0 | 220 | 93.5 |
| Resin | 57.0 | 250 | 98.0 |

It can be seen from the results that a reaction temperature higher than 180° C. is necessary.

EXAMPLE 4

In this example, the same autoclave as described in Example 1 was used and the effect of the amount of catalyst added to the water was tested. In this example, 0.5 g samples of dried granular ion exchange resins were used as the waste and 0.02 g of powdery calcium carbonate was used as the fusion preventing agent. The test was carried out under the same test conditions as those described in Example 1 except that the amount of copper sulfate catalyst was varied within a range from 0 to 3,000 ppm by weight, calculated as copper, based on the weight of the water and under a total pressure maintained between 40–41 kg/cm$^2$G. The results are shown in Table 4.

TABLE 4

| Amount of catalyst ppm | Conversion % | pH value for aqueous solution |
|---|---|---|
| 0 | 51.2 | 6.5 |
| 1 | 83.3 | 5.8 |
| 10 | 90.0 | 5.5 |
| 100 | 90.0 | 5.5 |
| 500 | 88.8 | 5.6 |
| 1000 | 88.6 | 5.7 |
| 3000 | 83.7 | 5.8 |

It can be seen from the results that at least 10 ppm by weight of the water soluble catalyst based on water is necessary as the effective metal catalyst.

EXAMPLE 5

In this example, the effect of other water-soluble metal salts was tested. The test was carried out under the same test conditions as those described in Example 1 except that 0.5 g of dry granular ion exchange resin was used as the waste and 0.02 g of calcium carbonate was used as the fusion preventing agent. The results of the test are shown in Table 5. In the Table, the type of catalyst is represented by the chemical formula of the water soluble salt of the metal used as the catalyst. The addition amount is represented by ppm of the weight of the metal used as the catalyst, based on the weight of water.

TABLE 5

| Kind of catalyst | addition amount ppm | Conversion % | pH value for aqueous solution |
|---|---|---|---|
| $Co(NO_3)_2.6H_2O$ | 471 | 74.6 | 6.6 |
| $Fe_2(SO_4)_3.5H_2O$ | 447 | 73.3 | 6.8 |
| $PdCl_2$ | 851 | 91.2 | 5.2 |
| $Ce(NO_3)_2.6H_2O$ | 1120 | 61.3 | 7.8 |
| $NiSO_4.6H_2O$ | 470 | 63.9 | 7.8 |
| $Cr_2(SO_4)_2.H_2O$ | 416 | 68.3 | 7.6 |
| $MnSO_4.H_2O$ | 440 | 82.5 | 6.2 |
| $Pb(NO_3)_2$ | 1650 | 70.5 | 7.4 |
| $H_2PtCl_6.6H_2O$ | 1560 | 84.5 | 6.1 |

The results show that various metals soluble in water are effective as the catalyst.

EXAMPLE 6

In this example, the effect of a supported metal catalyst insoluble in water was tested by using the same autoclave as described in Example 1. The waste materials that were used in Example 1, sheets of natural rubber cut into 30×30 mm pieces, or activated carbon were used, respectively, as waste materials. Samples of 1 g the waste material, 0.05 g of calcium carbonate as the fusion preventing agent, 250 ml of water and a specified amount of the catalyst as explained below, were charged in the autoclave. The autoclave was raised to a temperature 200° C. while being stirred. When a temperature of 200° C. was reached, oxygen at a partial pressure of 5 kg/cm$^2$ was introduced and the oxidizing decomposition reaction was permitted to proceed for one hour. The test was carried out in the same manner as described in Example 1 while maintaining the total pressure of the autoclave from 20 to 21 kg/cm$^2$G. Measurement for the results of the reaction was done in the same manner as in Example 1.

The water-insoluble supported catalysts used in this example were prepared as described below. The dried granular support was immersed in an aqueous solutions containing one of the water-soluble compounds of the group comprising copper sulfate, palladium chloride, chloroplatinic acid, ruthenium chloride and the like. The support was removed from the solution and dried at 110° C. Immersing-drying procedures were repeated a number of times until the amount of metal deposited on the support reached the desired level. The support containing the desired amount of metal was then reduced by contacting it with hydrogen at 300° C. to produce the desired water-insoluble supported catalyst. The support, and the amount and name of the metal contained in the catalyst are listed in the following table.

| Catalyst No. | Kind of metal | Kind of support | Metal weight in catalyst(%) |
|---|---|---|---|
| 1 | copper | alumina | 5.0 |
| 2 | palladium | alumina | 5.0 |
| 3 | palladium | alumina | 1.0 |
| 4 | palladium | alumina | 10.0 |
| 5 | platinum | alumina | 5.0 |
| 6 | ruthenium | alumina | 5.0 |
| 7 | copper | silica alumina | 5.0 |
| 8 | copper | zeolite | 5.0 |
| 9 | cobalt | αalumina | 5.0 |

The test results are shown in Table 6.

TABLE 6

| Kind of waste | Catalyst No. | Catalyst amount based on waste amount (%) | Conversion (%) | pH value for aqueous solution |
|---|---|---|---|---|
| Sheet | 1 | 5.0 | 53.3 | 6.8 |
| Sheet | 1 | 10.0 | 77.9 | 4.8 |
| Sheet | 1 | 100.0 | 78.5 | 4.7 |
| Sheet | 1 | 200.0 | 80.8 | 4.5 |
| Bottle | 1 | 200.0 | 71.8 | 6.2 |
| Natural rubber | 1 | 200.0 | 78.6 | 6.4 |
| Activated carbon | 1 | 200.0 | 50.0 | 8.2 |
| Sheet | 2 | 200.0 | 75.4 | 5.0 |
| Sheet | 3 | 200.0 | 73.2 | 5.2 |
| Sheet | 4 | 200.0 | 74.8 | 5.2 |
| Sheet | 5 | 200.0 | 70.5 | 5.5 |
| Sheet | 6 | 200.0 | 62.3 | 6.0 |
| Sheet | 7 | 200.0 | 78.2 | 4.7 |
| Sheet | 8 | 200.0 | 76.3 | 4.8 |
| Sheet | 9 | 200.0 | 78.4 | 5.0 |

It can be seen from the results that the water-insoluable supported catalyst is effective.

EXAMPEL 7

In this example, the same autoclave as described in Example 1 was used and the oxidizing decomposition test was carried out for a variety of different materials that may possibly be present in waste. Each 1 g sample of the materials shown in Table 7 was cut into pieces of about 30 mm length and was charged together with 0.2 g of copper sulfate pentahydrate as the water soluble catalyst, 0.05 g of calcium carbonate as the fusion preventing agent, and 0.1 g of solid sodium hydroxide as the neutralizing agent into the autoclave. The autoclave was heated under stirring to 230° C. and oxygen was introduced to establish a partial pressure of 7 kg/cm$^2$G. The oxidizing decomposition was carried out for one hour (three hours in the case of activated carbon only). The other test procedures were the same as those described in Example 1and the total pressure of the autoclave was maintained at 35–36 kg/cm$^2$G. The test results are shown in Table 7.

TABLE 7

| Kinds of waste | Conversion (%) |
|---|---|
| granular cationic exchange resin | 97.5 |
| granular anionic exchange resin | 85.3 |
| powdered cationic exchange resin | 97.1 |
| waste cloth | 97.5 |
| wood material | 97.7 |
| paper | 99.8 |
| polyethylene bottle | 97.1 |
| polychloroprene rubber sheet | 86.2 |
| hard vinyl chloride tube | 79.4 |
| soft vinyl chloride sheet | 83.7 |
| polypropylene bottle | 96.1 |
| natural rubber sheet | 92.4 |

TABLE 7-continued

| Kinds of waste | Conversion (%) |
|---|---|
| polymethylmethacrylate plate | 96.4 |
| polyvinylidene chloride film | 82.1 |
| nylon yarn | 67.8 |
| machine oil | 94.0 |
| grease | 90.4 |
| cellulose type filtration aids | 98.7 |
| activated carbon | 94.7 |

As is shown by the results, a wide variety of the materials that may possibly be incorporated into radioactive wastes can be processed in accordance with the present invention.

EXAMPLE 8

In this example, the same autoclave as described in Example 1 was used and the oxidizing decomposition treatment test was carried out using a mixed waste, one-half of which was composed of polyethylene. 4 g of mixed wastes comprising 50 wt. % shredded polyethylene, 20 wt. % shredded waste cloth, 15 wt. % shredded wood materials and 15 wt. % paper pieces, 250 ml of water, 0.2 g of copper sulfate pentahydrate as the water-soluble catalyst, 0.2 g of calcium carbonate as the fusion preventing agent and 0.5 g of solid sodium hydroxide as the neutralizing agent were charged into the autoclave, which was heated under stirring. After reaching 230° C., a partial pressure of 20 kg/cm$^2$ of oxygen was created in the autoclave and the oxidizing decomposition was carried out at that temperature for three hours. During reaction, gases were occasionally drawn off from the upper end of the autoclave and oxygen was supplemented to maintain the total autoclave pressure from 48–50 kg/cm$^2$G. The other test procedures and the treatment for the contents in the autoclave after the reaction were the same as those described im Example 1. Test results indicate a decomposition rate of 99.2% was obtained for such mixed waste, which corresponded to that of the individual wastes.

EXAMPLE 9

In this example, the same autoclave as described in Example 1 was used and the test was carried out, repeating the use of the water soluble copper catalyst. Mixed waste comprising 50 wt. % shredded polyethylene, 25 wt. % shredded waste cloth and 25 wt. % shredded chloroprene was used as the waste. For the first cycle of the oxidizing decomposition, 5 g of the mixed wastes, 250 ml of water, 0.2 g of copper sulfate pentahydrate as the catalyst, 0.25 g of calcium carbonate as the fusion preventing agent and 0.5 g of solid sodium hydroxide as the neutralizing agent were charged. Then, the autoclave was heated under stirring and when the temperature reached 230° C., oxygen was introduced at a partial pressure of 15 kg/cm$^2$. The reaction was permitted to proceed for three hours. Other test procedures during reaction and the analysis of the aqueous solution were the same as those described in Example 1. In the second and the succeeding oxidizing decomposition cycles, the same procedures as those described for the first cycle of the oxidizing decomposition were repeated, except that copper sulfate was not charged into the reactor. The test results are shown in Table 8. The decompusition rate in Table 8 was calculated as the ratio of the TOC of the aqueous solution remaining in the autoclave upon completion of the reaction for each cycle (the residual organic solid component was not present in each cycle) relative to TOC of wastes were charged prior to the start of the oxidizing decomposition of that cycle according to the formula as described in Example 1.

TABLE 8

| Number of reaction cycle | Conversion % | pH value for aqueous solution |
|---|---|---|
| 1 | 96.5 | 4.3 |
| 2 | 96.3 | 4.0 |
| 3 | 96.4 | 5.2 |
| 4 | 96.3 | 4.8 |
| 5 | 96.3 | 4.2 |
| 10 | 96.3 | 5.2 |
| 15 | 95.8 | 4.8 |
| 20 | 92.0 | 6.0 |

About 14 wt. % of deposited solid components, calculated on a dry weight basis, were present in the aqueous solution within the autoclave after completion of the oxidizing decomposition test at the 20th cycle, and the aqueous solution was still usable.

Many modifications and variations of the present invention are possible in light of the above teachings. It is therefore to be understood that within the scope of the appended claims the invention may be practiced otherwise than as specifically described.

What is claimed is:

1. A method of batchwise treating radioactive organic waste which is apt to melt and fuse to form large lumps, which comprises: introducing a first batch of radioactive organic waste into a bath of an aqueous reaction medium in a reactor, said reaction medium containing, as a fusion-preventing agent effective to prevent fusion of said radioactive waste, particles of one or more solid substances selected from the group consisting of silicon dioxide and the carbonates, hydroxides and oxides of calcium, barium, iron and zinc, the amount of said fusion-preventing agent being from 1.0 to 7.0% by weight, based on the weight of the radioactive organic waste to be treated, said reaction medium also containing a catalyst effective to catalyze oxidative decomposition of said radioactive organic waste;

closing the reactor and heating the contents thereof until the internal temperature of the reactor is from 180° to 250° C.;

supplying an oxygen-containing gas to the reactor so as to establish, in the reactor, an oxygen partial pressure of from 3 to 25 kg/cm$^2$, and oxidatively decomposing the radioactive organic waste in the reactor, at a temperature of from 180° to 250° C., while maintaining the pH of the aqueous reaction medium in the range of from higher than 0.01 to less than 8;

discharging gaseous effluents from the reactor which effluents are composed mainly of carbon dioxide, steam and non-condensable gases; and after said first batch of radioactive waste has been oxidatively decomposed, then supplying a second batch of radioactive organic waste and fusion-preventing agent to the aqueous reaction medium remaining in the reactor and repeating the oxidative decomposition under the same conditions as described above.

2. The method of batchwise treating radioactive organic waste as defined in claim 1, wherein solid matter is deposited in said reactor during repetitions of said batchwise treating method and wherein the method includes the step of discharging an excess amount of said solid matter prior to the subsequent supply of the radioactive organic waste and the fusion-preventing agent, when the amount of said solid matter remaining in the aqueous reaction medium exceeds a predetermined amount.

3. The method of batchwise treating radioactive organic wastes as defined in claim 1, wherein the fusion-preventing agent is added as a powder or in the form of an aqueous slurry into the reactor.

4. The method as defined in claim 1, wherein the catalyst is a compound of one or more of metals selected from the group consisting of copper, cobalt, iron, cerium, nickel, chromium, manganese and lead dissolved or deposited in the aqueous reaction medium, and the amount of said catalyst, calculated as the metal, is from 10 to 50,000 ppm by weight, based on the weight of the aqueous reaction medium in the reactor.

5. The method as defined in claim 1, wherein the catalyst is a supported catalyst comprising one or more of members selected from the group consisting of copper cobalt, palladium, platinum, ruthenium, and water-insoluble compounds thereof, supported at a ratio from 1 to 10% by weight on a support selected from the group consisting of alumina, silica-alumina and zeolite, and the amount of said supported catalyst in the reactor is from 10 to 200% by weight, based on the amount of radioactive organic wastes supplied batchwise into the reactor.

6. A method as defined in claim 1 in which the amount of said fusion-preventing agent in said reactor is from 2 to 4% by weight, the internal reaction temperature in the reactor is from 200° to 230° C., the oxygen partial pressure in the reactor is from 5 to 20 kg/cm$^3$ and the pH of the aqueous reaction medium in the reactor is from 3 to 6.

7. A method as defined in claim 1 in which said aqueous reaction medium and said catalyst are maintained in the reactor when oxidative decomposition of said first batch of radioactive waste has been completed and said second batch of radioactive organic waste is added to the reactor.

8. The method of batchwise treating radioactive organic waste as defined in claim 1, which includes the step of repeatedly discharging amounts of inorganic substance from the aqueous reaction medium prior to the subsequent supply of radioactive organic waste and fusion-preventing agent, when the amount of said inorganic substance remaining in the aqueous reaction medium exceeds a predetermined amount.

* * * * *